US005685030A

United States Patent [19]

Baranowski

[11] Patent Number: 5,685,030

[45] Date of Patent: Nov. 11, 1997

[54] LIFT FOR ENABLING A PERSON IN A WHEELCHAIR INTO AND OUT OF A POOL OR BODY OF WATER

[76] Inventor: Edwin M. Baranowski, 75 Marrus Dr., Gahanna, Ohio 43230

[21] Appl. No.: 674,205

[22] Filed: Jul. 1, 1996

[51] Int. Cl.[6] ..... E04H 4/14

[52] U.S. Cl. ..... 4/496; 4/561.1

[58] Field of Search ..... 4/496, 560.1, 561.1, 4/562.1, 563.1, 564.1, 565.1, 566.1

[56] References Cited

U.S. PATENT DOCUMENTS

| | | | |
|---|---|---|---|
| 3,088,123 | 5/1963 | Loughridge | 4/496 |
| 4,013,316 | 3/1977 | Cropper | 4/564.1 |
| 5,353,446 | 10/1994 | Báranowski | 4/496 |

OTHER PUBLICATIONS

Sunrise Medical / Guardian Products, Inc., 12800 Wentworth Street, Box C 4522, Arleta, CA 91331–4522, "Guardian® Poolift," Undated, Brochure, TA020 5M, 1 pg.

*Primary Examiner*—Robert M. Fetsuga

[57] ABSTRACT

A powered lift for facilitating the entry and exit of a person in a wheelchair 10 from the wheelchair and into a pool 2 and out of the pool back into the wheelchair including a platform support 19 secured to the pool deck to provide front sections 21 and 22 that define an opening there between and prevent movement of the wheelchair such that the wheelchair is positioned in operative relationship with a powered lift mechanism 30 such that a seat on the lift, which is optionally physiologically conformable, aligns with the forward edge of the seat of the wheelchair 15*f* in the upward extension of the lift to allow transfer of the person from the seat of the wheelchair to the seat of the lift and from the lift seat to the seat of the wheelchair in an essentially horizontal movement transverse to the forward edge of the wheelchair seat with the assistance of handrail guides 50.

13 Claims, 4 Drawing Sheets

LIFT FOR ENABLING A PERSON IN A WHEELCHAIR INTO AND OUT OF A POOL OR BODY OF WATER

FIELD OF THE INVENTION

This invention relates to improvements in powered devices for enabling the entry and exit of a person in a wheelchair into and out of a pool or body of water and more specifically to a powered adaptation means described in my U.S. Pat. No. 5,353,446 issued on Oct. 11, 1994, "Means for Facilitating the Entry and Exit of a Person in a Wheelchair into and out of a Pool or Body of Water." The disclosure and definitions contained in that patent are incorporated herein by reference for all purposes.

BACKGROUND OF THE INVENTION

As my patent relates, swimming and water therapy are optimum forms of recreation, exercise and conditioning for wheelchair challenged persons, but oftentimes, access to a pool or entry into a body of water is not easy. The prior art has suggested the use of hoists, basket lifts, water powered seat lifts and other devices to move a person from a wheelchair into a pool and to remove that person from the pool and return the person to the wheelchair. In most instances, the person in the wheelchair is assisted and the assistant provides some role in the placement and use of a mechanical assistance device.

OBJECTS AND SUMMARY OF THE INVENTION

An object of the present invention is to facilitate pool access and to provide a mechanized access means for wheelchair challenged persons having a design that permits a forward and rearward entry and exit on to a lift platform for descent into and ascent from a water pool. The lift does not require side transfers and is likely to find use in public, private club, institutional, hotel and resort and personal swimming and therapy pools. As used herein "pool" refers to conventional pools, however, it is evident that the access device herein can be adapted for use at a swimming area of a lake or ocean, such as with a appropriately configured section of a dock, or the swimming or diving platform of a boat. Hence, the pool access contemplated extends to an environment encountered by a wheelchair challenged person requiring water entry, and exit, for sport, therapy or other purpose. It is another object to provide a powered lift that can be installed unobtrusively at a pool corner or side that is of simple construction and easy to use.

These and other objects and achievements of the invention are more clearly explained with reference to the following description taken in conjunction with the drawings in which:

DESCRIPTION OF THE PREFERRED EMBODIMENT

Figure 4:
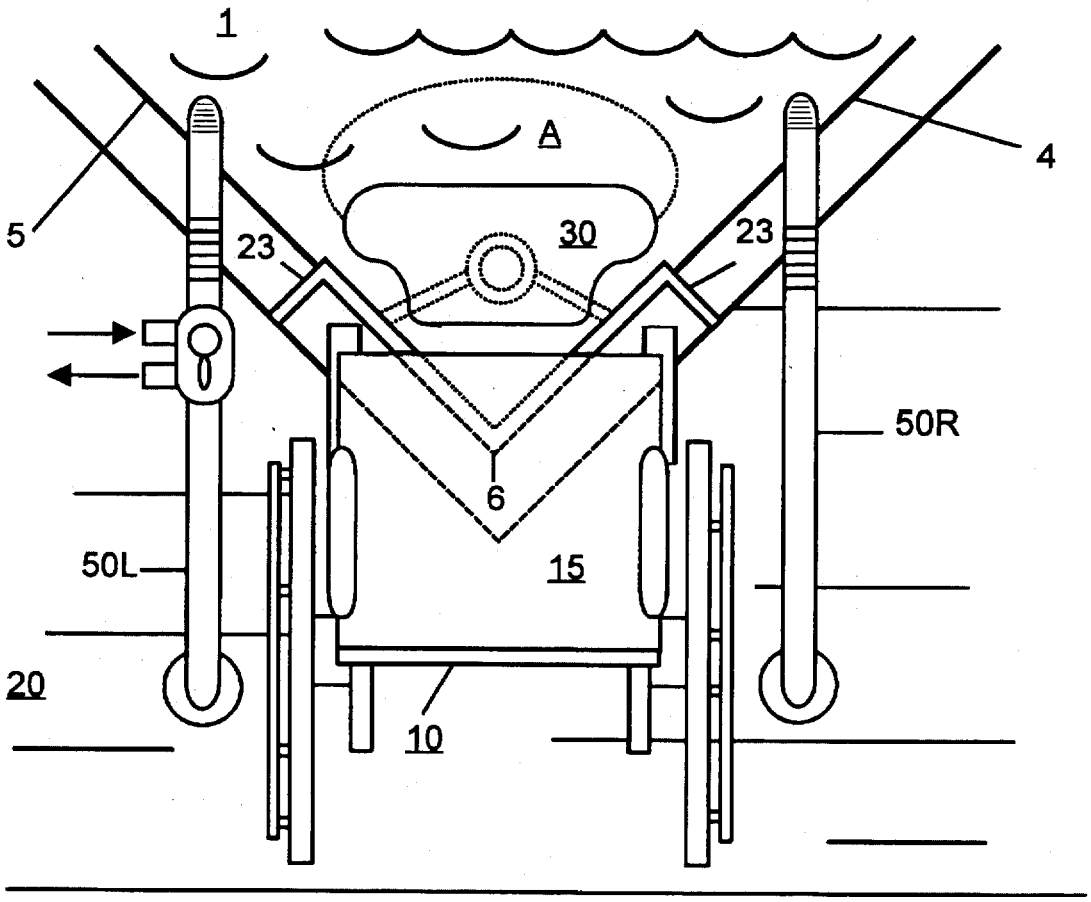
FIG. 4 is a top view of an alternate corner installation.

The invention provides a powered lift for facilitating the entry and exit of a person, from a wheelchair into and out of a pool. In the view shown in FIG. 1, the wheelchair 10 is disposed at a side of a pool, typically on the pool deck 20. With reference to the pool and wheelchair shown in the figures, a typical pool includes a volume of water 1 having a surface 2 contained within a closed construction. A pool side is shown at 3 where the device is installed. FIG. 4 illustrates a corner installation and the relationship of the device with regard to pool sides 4 and 5 that meet at corner 6. Some pools have a wave or splash gutter, such as shown at 7 in FIG. 1, slightly above the water surface 2 and below the pool deck 20.

Figure 1:
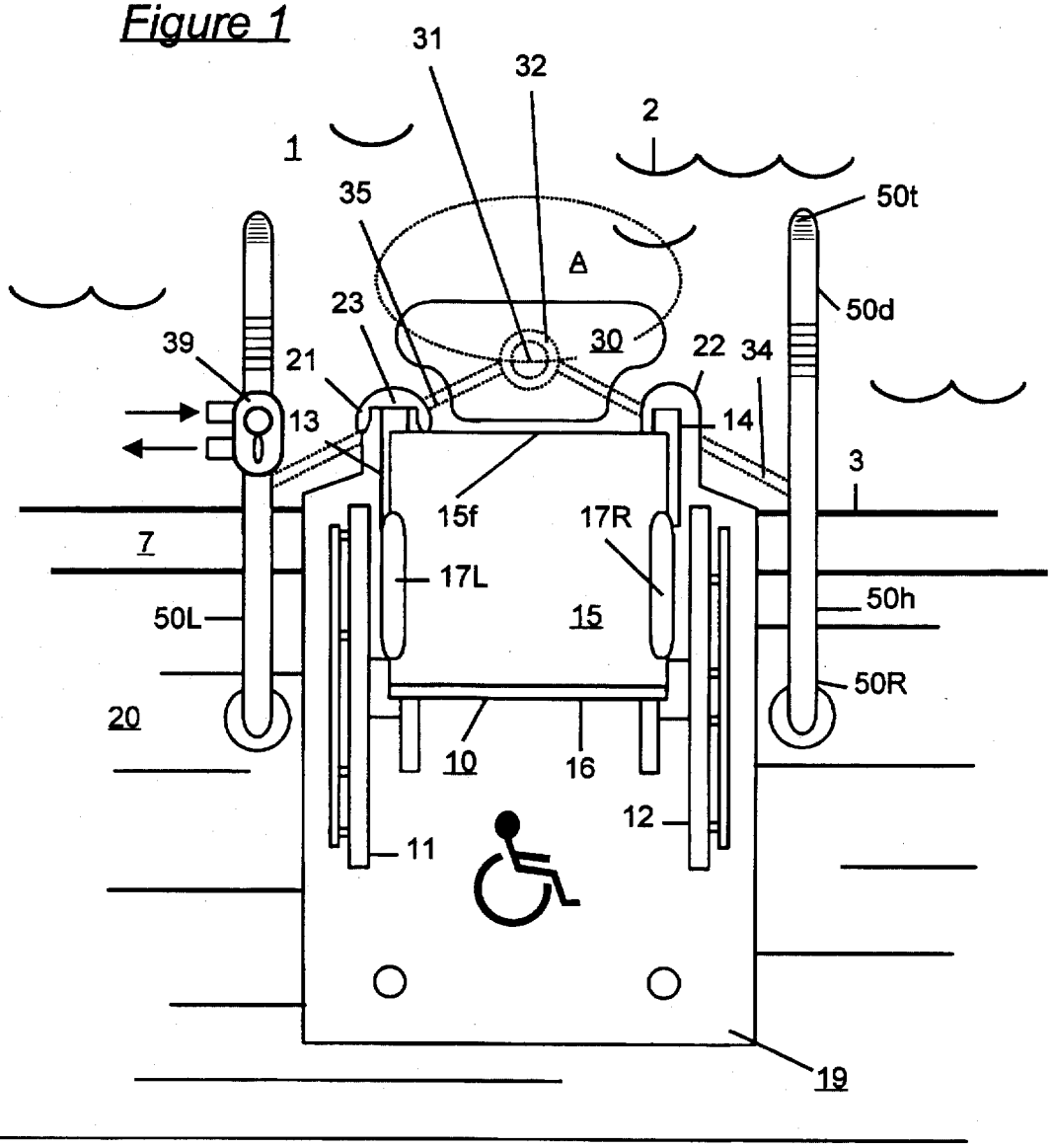
FIG. 1 is a top view of a wheelchair positioned at a pool side in operative relationship with the lift mechanism.

Wheelchairs 10 are known and usually include large diameter rear wheels 11 and 12, smaller front wheels 13 and 14, seat 15 and back 16. In a typical chair the seat is about 16 to 18 inches (40 to 50 centimeters) wide. The front wheels of the chair are spaced apart about 19.5 inches (50 centimeters). Because chairs differ, these "typical" dimensions vary. In the configuration of FIG. 1, positioning platform 19 aligns the forward edge of the seat of the wheelchair in a perpendicular relationship with the surface of the water in the pool, such that the forward seat edge **15*f* extends a distance laterally over the water surface away from the pool side[s]. The lift seat 30 is positionally fixed with respect to the forward seat edge of the wheelchair such that it is within the pool, spaced away from the pool side[s]. When elevated, the rear edge of the lift seat is adjacent the forward edge 15*f*** of the wheelchair seat. The movement of the lift carrying the person is a direct vertical movement into the water, essentially into area A, uninterrupted by a physical barrier of a pool side. The seat platform includes a firm base plate that is preferably shaped and/or padded with a physiologically conforming/conformable material adapted/adaptable to the shape of buttocks. An example of such a material is an Ensolite® closed cell vinyl covered polyurethane form that is otherwise used in water recreation or safety devices. The foam provides cushioning and pressure relief, an important consideration for many people in wheelchairs.

The alignment platform 19 shown in FIG. 1 provides a support which is secured, or otherwise formed at a corner or side of the pool perimeter. The platform 19 provides two forwardly extending sections 21 and 22, each of which receives thereon the front wheels 13 and 14 of each side of the wheelchair. The forward sections 21 and 22 are disposed with respect to water in the pool such that, when the wheelchair rests thereon, at least a portion of the seat of the wheelchair, measured from the front edge thereof, is disposed vertically with respect to the water surface, a distance away from the pool side[s]. A pool corner is typically square as shown in FIG. 4, however a "corner," as contemplated herein may include an obtuse, acute, rounded, or polygonal sectioned joinder of pool sides. In any such corner configuration, the stated vertical relationship of the wheelchair seat, lift seat, pool sides and water surface as described above are provided. Alternative platform and stop means and installations are described in my U.S. Pat. No. 5,353,446.

The platform includes a barrier 23 for preventing movement of the chair wheels to prevent the chair from rolling into the water. Whenever the device is used, the chair should be braked. If the brakes tail, the barrier prevents the chair, and/or person therein from falling into the pool. Typically this barrier 23 will include a frontal, and optionally side, lip extending upwards from the surface of the platform about 25 to 75 or more millimeters (about one to three inches) at one or preferably both front sides or sections of the platform. A side lip parallel to the sides of the chair and its wheels assists in aligning the wheelchair in the center of the device, or in the center of the pool corner, if the platform is so installed, so that the proper positioning of the wheelchair is achieved. The "v" shape of the corner installation of FIG. 4, and the separated sections of the embodiment of FIG. 1 make the device essentially self-aligning to place the chair in a proper position with regard to the lift seat 30. A conventional pool rail or specially adapted rails are installed adjacent the sides of the wheelchair position as shown at 50L and 50 R in FIGS. 1, 2 and 4. The rails are attached to the pool deck 20 at each side of the wheelchair and extend horizontally in sections 50*h* at the approximate level of the chair arms 17L and 17R. The rails then slope downward in sections 50*d* toward the water surface and have terminating sections 50*t* in the pool attached or secured to the pool wall or floor.

Figure 2:
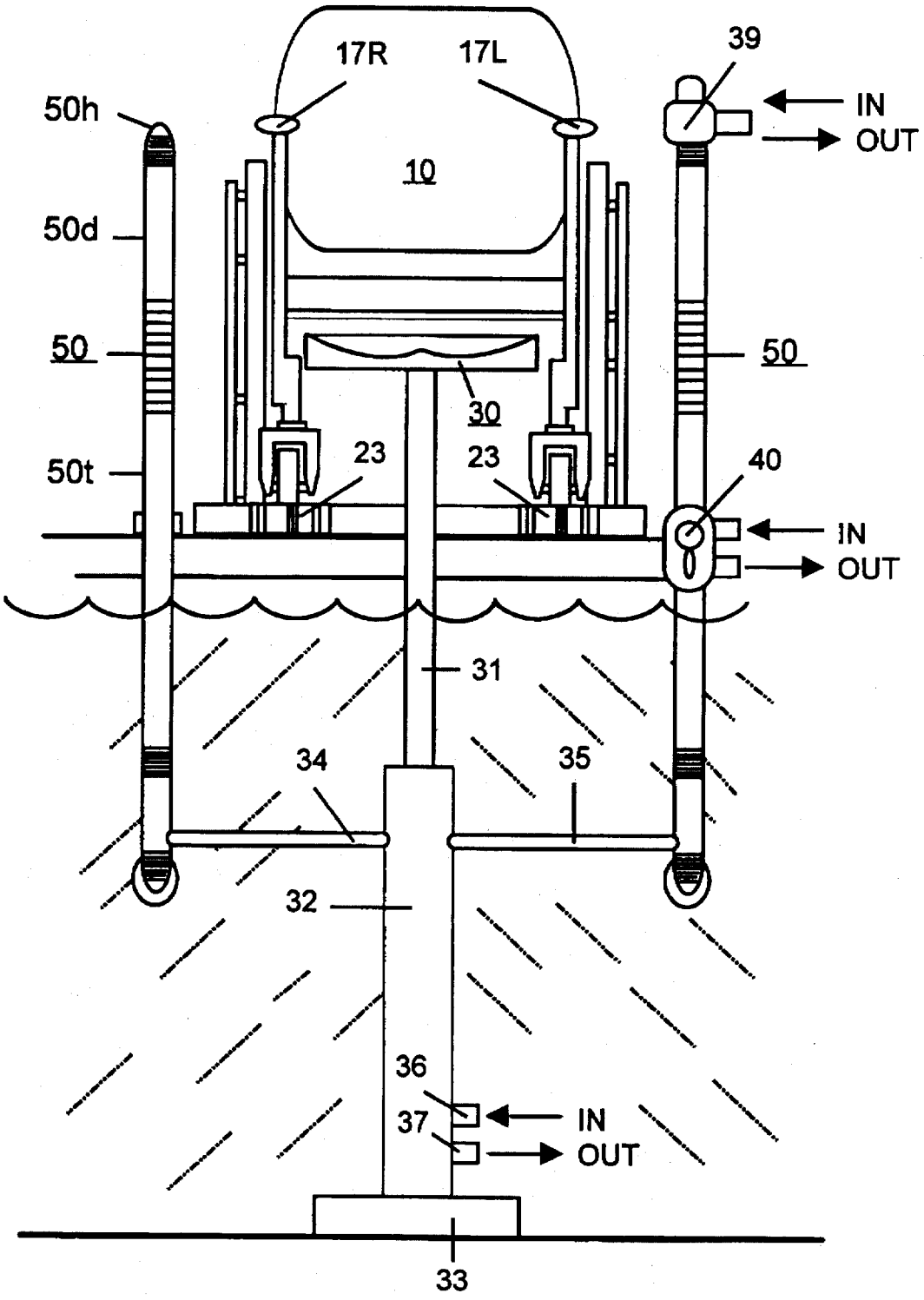
FIG. 2 is a front view showing the chair and mechanism with respect to the pool bottom, side wall and deck, and side railings.
Figure 5:
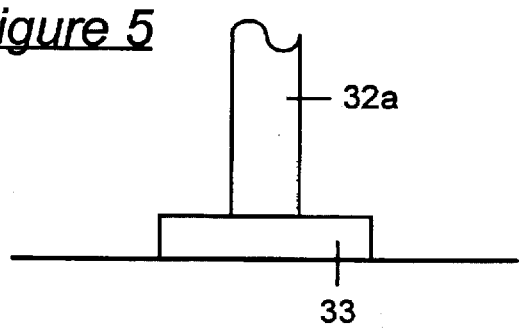
FIG. 5 is a front view of an alternate lift mechanism.

FIG. 2 shows the lift mechanism with regard to the wheelchair, the pool and the rails. The lift preferably utilizes a conventional water powered hydraulic mechanism such as used in prior art devices such as the Guardian® Poolift manufactured by Sunrise Medical, Guardian Products, Inc., 12800 Wentworth Street, Box C 4522, Arleta, Calif. 91331–4522 or an appropriately protected gear or chain system driven by a motor as shown in FIG. 5 at 32*a*. In the device of the application, however, the lift seat 30 is connected to rod 31 that extends from a hydraulic piston enclosed in hydraulic cylinder 32 that is preferably extended at the pool floor by base plate 33, although the base may also be supported from the pool side[s]. Upper and lower toggle control switches for the lift are shown at 39 and 40 connected to hydraulic fluid lines that introduce and permit the outlet of the fluid into 36 and out of 37 the cylinder 32. For clarity in the drawings the hydraulic connecting lines are not shown. Because the lift operates in up and down positions, down switch 39 at the arm level of the wheelchair will allow the lift to descend when a person enters the pool, i.e., allowing fluid to exit cylinder 32 through outlet 37; up switch 40 at the lower level, used when a person is exiting the pool, will allow the hydraulic fluid to enter cylinder 32 at inlet 36 and consequently raise the lift and the person thereon. Use of a multiple position switch will allow up or down control of the lift at either location. As shown in FIG. 2 side struts 34 and 35 extend from the cylinder 32 and are attached either to the side rails or directly to the pool sides. In this manner, a firm triangulated support is provided for the lift mechanism. The dashed lines in the top view of FIG. 1 also shows the triangulated support of the lift.

In use, the wheelchair, including the person in the wheelchair, is first positioned on the platform as shown in the top views of FIGS. 1 and 4. The person will then move forward horizontally from the chair seat 15 onto the lift seat 30. This will usually be accomplished with the aid of an assistant and/or use of the side rails 50. The person's legs should be positioned in the front of the lift seat. This is accomplished by moving a leg separately to the side of the lift seat and placing the leg in front of the lift seat. Once one leg is in front, the other leg is similarly positioned and the person can then position her/him self on the seat 30. Alternatively, with the lift seat in the down position, the person can move forward in the chair and then raise the lift from below so that the lift automatically positions itself behind the person's knees below the thighs, putting the person in position for adjustment on the lift seat as accomplished in the above procedure. In the seat, the person shifts the upper switch 39 to the down position to enter the water. In exiting from the pool, the swimmer backs into lift seat 30 in its lowered position and positions switch 40 in its up position. The lift then carries the swimmer up to the level of the wheelchair seat, where the swimmer then backs into the chair seat 15 from the lift seat 30. The use of three way up/neutral/down switches at both levels facilitates the entry and exit process. For example, the wheelchair may be positioned on the platform when the lift is in a down position and then raised beneath the extending thighs of the person in the chair. This may facilitate transfer onto the lift seat.

Figure 3:
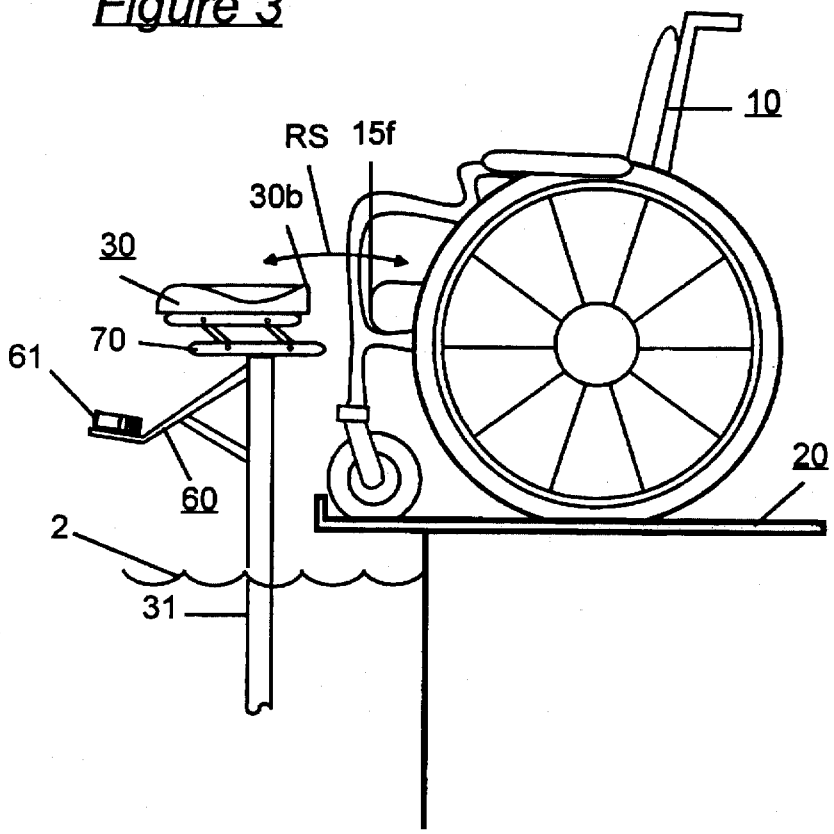
FIG. 3 is a side view showing an alternative arrangement for the lift seat and an optional foot support.

FIG. 3 shows a side view of an alternative arrangement for the lift seat and an optional foot support. In the figure, a reciprocating seat for the lift is shown that shifts between two horizontal positions indicated by arrow RS: one position in which the back side 30*b* of the lift seat 30 is proximate to and in contact with the forward edge 15*f* of the wheelchair, the second in which the back side 30*b* of the lift seat 30 is disposed a greater distance away from the wheelchair seat and the pool side than if the seat were in a fixed position. The movement of the seat may be permitted by a mechanism 70, such as a slide, the back and forth pivoting toggle shown, or similar mechanism. An advantage of the horizontally movable seat is that it allows the seat and the hydraulic piston to be positioned a farther distance away from the pool side[s] and the front edge of the wheelchair seat, reducing opportunity for undesired contact of the person with hard mechanical edges of the apparatus in up and down movement of the lift. Padded foam cushioning used at potential contact edges in any embodiment will also reduce instances of hard contact. When the lift seat is in contact with the wheelchair seat, transfer from one to the other is facilitated.

FIG. 3 also shows an optional footrest for the lift 60 which may be a conventional stirrup support 61 for each foot or a full width support for both feet. The footrest may be retractable vertically or rotatable to the side depending on design preference.

The device is intended preferably for permanent installation. An advantage of the lift is that should a person not desire the assistance of a lift, the seat may be put in the down position, and the person may manually use the positioning platform and side rails to achieve water entry and exit in the manner described in my earlier referenced patent.

I claim:

1. A lift enabling the entry and exit of a person in a wheelchair from the wheelchair and into a pool and out of the pool back into the wheelchair, the wheelchair including a pair of front and rear wheels and a seat, the pool including substantially vertical sides and a substantially horizontal deck defining an upper edge, said lift comprising:

a positioning platform securable to the pool deck at the edge thereof, said platform having two spaced apart front sections defining an opening therebetween, each section capable of receiving a respective one of the front wheels of the wheelchair, such that when the wheelchair is disposed thereon, at least a portion of the front edge of the seat of the wheelchair can be positioned vertically with respect to the water surface over the water and spaced from the pool edge, said platform including a stop for preventing movement of the wheelchair beyond a front edge portion of the front sections, a powered mechanism positionable on the platform and including a lift seat alignable with the forward edge of the seat of the wheelchair in an up position of the mechanism whereby movement of the person from the seat of the wheelchair to the lift seat and from the lift seat to the seat of the wheelchair is an essentially horizontal movement transverse to the forward edge of the wheelchair seat, at least one side rail anchorable adjacent a side of the positioning platform, the side rail forwardly extendable over the pool, the side rail for grasping by the person using the wheelchair in the movement of that person from the wheelchair seat to the lift seat and from the lift seat the wheelchair seat; and control means for directing the elevation of the mechanism from the up position whereby the lift seat is in an essentially horizontal alignment with the wheelchair seat to a down position in which the lift seat is in the pool.

2. The lift of claim 1 wherein the lift mechanism includes a piston and cylinder powered by hydraulic water pressure.

3. The lift of claim 1 installable at a pool side.

4. The lift of claim 1 installable at a pool corner.

5. The lift of claim 1 wherein the control means includes an upper control and a lower control accessible to the person in the wheelchair for controlling the up and down positioning of the lift seat.

6. The lift of claim 5 in which both the upper and lower controls determine whether the lift seat is in the up or down position.

7. The lift of claim 1 in which the lift seat is capable of back and forth toggle movement in a horizontal plane.

8. The lift of claim 1 including a foot support on the powered mechanism in cooperative relationship with the lift seat.

9. The lift of claim 1 in which the lift seat is physiologically conformable to the buttocks of the person using the lift.

10. The lift of claim 9 in which the lift seat is formed from a polymer foam having a water impermeable coating.

11. The lift of claim 1 wherein the platform includes a planar plate securable to the pool deck.

12. The lift of claim 1 including a second side rail, the side rails being securable at each side of the platform such that the rails may be grasped by the person using the wheelchair.

13. The lift of claim 1 including a motor for driving the lift mechanism.

* * * * *